US009293114B2

(12) United States Patent
Koide

(10) Patent No.: US 9,293,114 B2
(45) Date of Patent: Mar. 22, 2016

(54) LIQUID CRYSTAL DISPLAY APPARATUS, METHOD OF DRIVING LIQUID CRYSTAL DISPLAY APPARATUS, AND ELECTRONIC APPARATUS

(71) Applicant: Japan Display Inc., Tokyo (JP)

(72) Inventor: Gen Koide, Aichi (JP)

(73) Assignee: Japan Display Inc., Tokyo (JP)

( * ) Notice: Subject to any disclaimer, the term of this patent is extended or adjusted under 35 U.S.C. 154(b) by 158 days.

(21) Appl. No.: 13/752,921

(22) Filed: Jan. 29, 2013

(65) Prior Publication Data

US 2013/0249957 A1 Sep. 26, 2013

(30) Foreign Application Priority Data

Mar. 22, 2012 (JP) ..... 2012-064752

(51) Int. Cl.

| | |
|---|---|
| ***G09G 5/10*** | (2006.01) |
| ***G09G 3/34*** | (2006.01) |
| *G09G 3/36* | (2006.01) |

(52) U.S. Cl.

CPC ..... *G09G 5/10* (2013.01); *G09G 3/3406* (2013.01); *G09G 3/3648* (2013.01); *G09G 3/3655* (2013.01); *G09G 3/3614* (2013.01); *G09G 2300/0452* (2013.01); *G09G 2320/0204* (2013.01); *G09G 2320/0247* (2013.01); *G09G 2320/064* (2013.01); *G09G 2330/021* (2013.01); *G09G 2360/145* (2013.01); *G09G 2360/16* (2013.01)

(58) Field of Classification Search

CPC ..... G09G 3/3655; G09G 5/10; G09G 3/3406; G09G 3/3648; G09G 3/3614; G09G 2360/16; G09G 2360/145; G09G 2320/0209; G09G 2320/0204; G09G 3/0214; G09G 3/0247; G09G 3/064; G09G 3/0626; G09G 2320/021; G09G 2300/0452

See application file for complete search history.

(56) References Cited

U.S. PATENT DOCUMENTS

| | | | | |
|---|---|---|---|---|
| 7,688,394 | B2 | 3/2010 | Yasui et al. | |
| 2008/0084524 | A1 | 4/2008 | Inuzuka et al. | |
| 2008/0252582 | A1* | 10/2008 | Wei | 345/89 |
| 2009/0109165 | A1* | 4/2009 | Park et al. | 345/102 |
| 2009/0128527 | A1 | 5/2009 | Itakura et al. | |
| 2010/0079429 | A1* | 4/2010 | Hirose et al. | 345/209 |
| 2011/0175874 | A1 | 7/2011 | Wakimoto et al. | |
| 2011/0181633 | A1* | 7/2011 | Higashi | G09G 3/2003 345/691 |

(Continued)

FOREIGN PATENT DOCUMENTS

| | | |
|---|---|---|
| JP | 2005-292493 | 10/2005 |
| JP | 2008-096548 | 4/2008 |
| JP | 2012-027405 | 2/2012 |

(Continued)

OTHER PUBLICATIONS

Office Action issued in connection with Taiwan Patent Application No. 101143138, dated Sep. 18, 2014. (11 pages).

(Continued)

*Primary Examiner* — Grant Sitta
*Assistant Examiner* — Amen Bogale
(74) *Attorney, Agent, or Firm* — K&L Gates LLP

(57) ABSTRACT

A liquid crystal display apparatus includes: a detection unit that detects the luminance of a backlight unit; and a controller that controls a voltage of a counter electrode, shared by pixels, based on a detection result of the detection unit.

6 Claims, 6 Drawing Sheets

(56) References Cited

U.S. PATENT DOCUMENTS

| | | | | |
|---|---|---|---|---|
| 2012/0026211 | A1 | 2/2012 | Kikuchi et al. | |
| 2012/0069057 | A1 * | 3/2012 | Ikeda | G09G 3/3614 345/690 |

FOREIGN PATENT DOCUMENTS

| | | | | |
|---|---|---|---|---|
| TW | 200405082 | 4/2004 | | |
| TW | 200923481 | 6/2009 | | |
| TW | 201137839 | 11/2011 | | |
| WO | 2010/116447 | 10/2010 | | |
| WO | WO 2010116447 | A1 * | 10/2010 | G09G 3/3614 |

OTHER PUBLICATIONS

Notice of Rejection issued in connection with Japanese Patent Application No. 2012-064752, dated Mar. 17, 2015. (10 pages).

* cited by examiner

LIQUID CRYSTAL DISPLAY APPARATUS, METHOD OF DRIVING LIQUID CRYSTAL DISPLAY APPARATUS, AND ELECTRONIC APPARATUS

CROSS REFERENCES TO RELATED APPLICATIONS

The present application claims priority to Japanese Priority Patent Application JP 2012-064752 filed in the Japan Patent Office on Mar. 22, 2012, the entire content of which is hereby incorporated by reference.

BACKGROUND

The present disclosure relates to a liquid crystal display apparatus, a method of driving a liquid crystal display apparatus, and an electronic apparatus.

In a liquid crystal display apparatus, in order to prevent a deterioration in the specific resistance of liquid crystal (resistance value of a substance) and the like caused by continuously applying a DC voltage having the same polarity to a liquid crystal, the polarity of a voltage, which is applied between a common electrode (counter electrode) and pixel electrodes of pixels, is reversed at given periods, that is, so-called AC drive is performed.

In AC drive, when frame reversal drive in which the given periods are set to frame periods is performed, transmittance of light is different in a frame in which the voltage of the pixel electrodes is larger than that of the counter electrode and in a frame in which the voltage of the pixel electrodes is smaller than that of the counter electrode. As a result, the display intensity of a liquid crystal panel (liquid crystal display apparatus) varies depending on frames, which leads to a deterioration in image quality such as screen flickering.

AC drive is performed by applying a square-wave voltage, in which the polarity is reversed based on a common voltage $V_{com}$ applied to a counter electrode (common electrode), to pixel electrodes. This common voltage $V_{com}$ is adjusted to the optimum voltage value (optimum value) so as to minimize flickering, for example, caused by AC drive, in the manufacturing process of a liquid crystal panel (liquid crystal display apparatus).

However, in the manufacturing process of a liquid crystal panel, that is, before shipment of a liquid crystal panel, even when the common voltage $V_{com}$ is adjusted to the optimum value so as to minimize flickering, the common voltage $V_{com}$ may be shifted from the optimum value due to changes in ambient environment and the like after shipment of a liquid crystal panel. To solve this problem, in the related art, a configuration of detecting ambient temperature and/or the intensity of external light with a sensor and adjusting a voltage value of the common voltage $V_{com}$ based on the detection results is disclosed (for example, JP-A-2005-292493).

SUMMARY

The luminance of a backlight unit may be changed as necessary. By changing the luminance of a backlight unit, a voltage value of the common voltage $V_{com}$ is changed so as to minimize flickering based on the luminance. However, in the configuration disclosed in JP-A-2005-292493 of detecting ambient temperature and/or the intensity of external light with a sensor, it is difficult to deal with changes in the luminance of a backlight unit.

When the changed luminance of a backlight unit is different from the luminance of the backlight unit measured when the common voltage $V_{com}$ is adjusted so as to minimize flickering, a voltage value of the common voltage $V_{com}$ is shifted from the optimum value. As a result, it is difficult to apply the optimum voltage corresponding to a level of a video signal between a pixel electrode and a counter electrode of a liquid crystal capacitor and thus there is little margin for flickering, screen burn-in, and other non-uniform display.

It is therefore desirable to provide a liquid crystal display apparatus, a method of driving a liquid crystal display apparatus, and an electronic apparatus, in which the optimum voltage corresponding to a level of a video signal is applied between a pixel electrode and a counter electrode of a liquid crystal capacitor based on the changed luminance of a backlight unit.

An embodiment of the present disclosure is directed to a liquid crystal display apparatus including a detection unit that detects the luminance of a backlight unit; and a controller that controls a voltage of a counter electrode, shared by pixels, based on a detection result of the detection unit. It is preferable that the liquid crystal display apparatus according to the embodiment be used as a display unit for various electronic apparatuses.

Another embodiment of the present disclosure is directed to a method of driving a liquid crystal display apparatus including detecting the luminance of a backlight unit; and controlling a voltage of a counter electrode, shared by pixels, based on a detection result for the luminance of the backlight unit.

According to the embodiments of the present disclosure, since a voltage of a counter electrode is controlled based on the luminance of a backlight unit, the optimum voltage corresponding to a level of a video signal can be applied between a pixel electrode and the counter electrode based on the changed luminance of the backlight unit.

Additional features and advantages are described herein, and will be apparent from the following Detailed Description and the figures.

DETAILED DESCRIPTION

Figure 1:
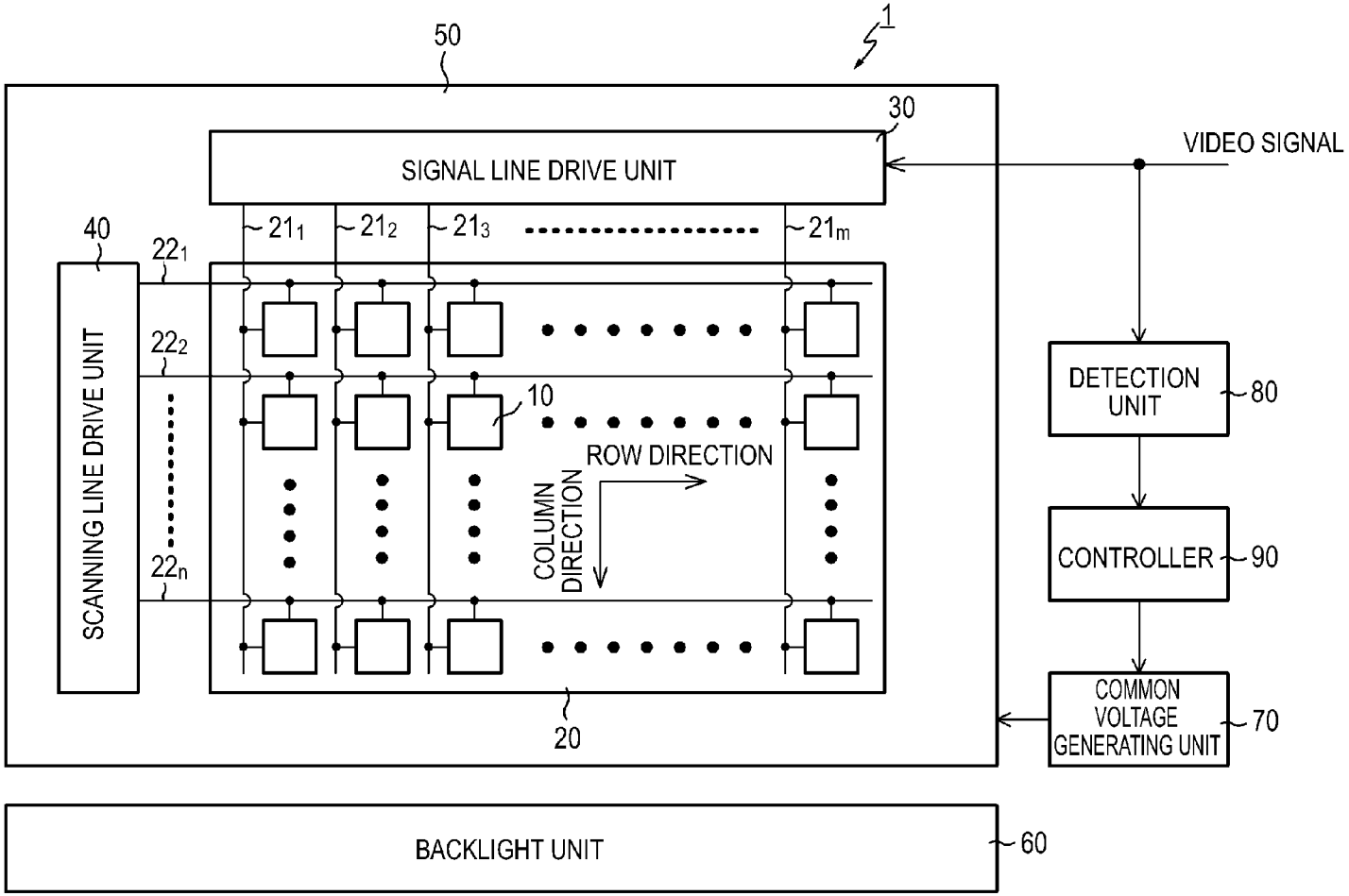
FIG. 1 is a diagram schematically illustrating a system configuration of an active-matrix liquid crystal display apparatus according to an embodiment of the present disclosure.

Hereinafter, embodiments of the present disclosure (hereinafter, referred to as "embodiments") will be described with reference to the drawings. The present disclosure is not limited to the embodiments and various numerical values described in the embodiments are merely examples. The description will be performed in the following order.

1. Overall Description Relating to Liquid Crystal Display Apparatus, Method of Driving Liquid Crystal Display Apparatus, and Electronic Apparatus According to Embodiments of Present Disclosure 2. Liquid Crystal Display Apparatus According to Embodiment of Present Disclosure 2-1. System Configuration 2-2. Mechanism in Which Common Voltage $V_{com}$ Is Shifted From Optimum Value 2-3. Characteristics of Embodiment 2-4. Modification 3. Modification 4. Configurations According to Embodiments of Present Disclosure <1. Overall Description Relating to Liquid Crystal Display Apparatus, Method of Driving Liquid Crystal Display Apparatus, and Electronic Apparatus According to Embodiments of Present Disclosure>

A liquid crystal display apparatus according to an embodiment of the present disclosure may be a monochrome liquid crystal display apparatus or a color liquid crystal display apparatus. In the color liquid crystal display apparatus, one pixel (unit pixel), which is a unit of forming a color image, includes plural subpixels.

More specifically, in the color liquid crystal display apparatus, one pixel includes three subpixels, for example, a first subpixel which displays a first primary color (for example, red), a second subpixel which displays a second primary color (for example, green), and a third subpixel which displays a third primary color (for example, blue). Furthermore, in order to improve luminance, one pixel can include four subpixels including a fourth subpixel which displays a fourth color (for example, white) in addition to the first, second, and third subpixels.

The liquid crystal display apparatus according to the embodiment includes a backlight unit as an illumination unit which illuminates a liquid crystal panel, formed by arranging pixels, with light from a back side thereof. A configuration of the backlight unit is not particularly limited, and the backlight unit can be configured using well-known members including a light source such as a light emitting diode (LED) or a fluorescent tube, a prism sheet, a diffusion sheet, and a light guide plate.

The luminance of the backlight unit may be dynamically changed as necessary. For example, in a liquid crystal display apparatus having the four-subpixel configuration which includes the fourth color (for example, white) in order to improve luminance, when only the same luminance as that of the three-subpixel configuration not including the fourth color is necessary, the luminance of the backlight unit can be reduced by an amount of luminance improved. By reducing the luminance of the backlight unit, power consumption can be reduced. Therefore, in a liquid crystal display apparatus having the four-subpixel configuration including the fourth color, in order to reduce power consumption, for example, a method of changing the luminance of the backlight unit to be reduced may be adopted.

The liquid crystal display apparatus according to the embodiment includes a detection unit that detects the luminance of a backlight unit; and a controller that controls a voltage of a counter electrode, shared by pixels, based on a detection result of the detection unit. By controlling a voltage of a counter electrode based on a detection result for the luminance of the backlight unit, the optimum voltage corresponding to a level of a video signal can be applied between a pixel electrode and the counter electrode based on the changed luminance of the backlight unit described above.

In a liquid crystal display apparatus, a method of driving a liquid crystal display apparatus, and an electronic apparatus according to embodiments of the present disclosure which have the above-described preferable configurations, when the four-subpixel configuration including white is adopted, the luminance of a backlight unit can be changed according to a level of a video signal applied to a pixel electrode. At this time, a detection unit which detects the luminance of a backlight unit can detect the luminance of the backlight unit from a level of a video signal.

In a liquid crystal display apparatus, a method of driving a liquid crystal display apparatus, and an electronic apparatus according to embodiments of the present disclosure which have the above-described preferable configurations, a controller which controls a voltage between a pixel electrode and a counter electrode controls a common voltage, applied to the counter electrode, based on a detection result of a detection unit which detects the luminance of a backlight unit.

When a difference between leakage current values of a pixel transistor when the changed luminance of the backlight unit has the maximum value and the minimum value is represented by $\Delta I_{photo}$[A], one frame period is represented by $T_f$[sec], a pixel capacitance is represented by $C_{pic}$[F], the maximum gradient between a DC value of the common voltage and a flicker rate is represented by S[%/V], a flicker rate of the common voltage, which is adjusted so as to minimize flickering, is represented by F[%], and a standard flicker rate is represented by L[%], an expression of $\Delta I_{photo} \times T_f / C_{pic} \times S + F > L$ is satisfied.

Alternatively, in a liquid crystal display apparatus, a method of driving a liquid crystal display apparatus, and an electronic apparatus according to embodiments of the present disclosure which have the above-described preferable configurations, a controller which controls a voltage between a pixel electrode and a counter electrode can control a signal level of a video signal based on a detection result of a detection unit which detects the luminance of a backlight unit.

<2. Liquid Crystal Display Apparatus According to Embodiment of Present Disclosure>

Next, an active-matrix liquid crystal display apparatus which is a liquid crystal display apparatus according to an embodiment of the present disclosure will be described.

[2-1. System Configuration]

FIG. 1 is a diagram schematically illustrating a system configuration of an active-matrix liquid crystal display apparatus according to an embodiment of the present disclosure. The active-matrix liquid crystal display apparatus according to the embodiment is a color liquid crystal display apparatus. However, the present disclosure can be applied to a monochrome liquid crystal display apparatus in addition to a color liquid crystal display apparatus.

As illustrated in FIG. 1, a liquid crystal display apparatus 1 according to the embodiment includes a pixel array (pixel portion) 20 which is obtained by arranging pixels 10 in a two-dimensional matrix and peripheral drive circuits such as a signal line drive unit 30 and a scanning line drive unit 40. In this embodiment, the signal line drive unit 30 and the scanning line drive unit 40 are mounted onto the pixel array 20 and a substrate. The signal line drive unit 30 and the scanning line drive unit 40 may be provided outside a liquid crystal panel 50.

As is well known in the related art, the liquid crystal panel 50 has a structure in which two substrates (not illustrated; at least one of which is transparent) are disposed opposite each other with a predetermined gap and liquid crystal is sealed between the two substrates. One substrate is provided with a pixel electrode for each pixel and the other substrate is provided with a counter electrode (common electrode) shared by pixels.

In the pixel array 20 with n rows and m columns, signal lines $\mathbf{21}_1$ to $\mathbf{21}_m$ (hereinafter, simply referred to as "signal lines 21" in some cases) are respectively arranged for the columns of pixels along a column direction. In addition, scanning lines $\mathbf{22}_1$ to $\mathbf{22}_n$ (hereinafter, simply referred to as "scanning lines 22" in some cases) are respectively arranged for the rows of pixels along a row direction.

In the description, the column direction represents a direction in which pixels in columns are arranged (that is, vertical direction) and the row direction represents a direction in which pixels in rows are arranged (that is, horizontal direction).

Each end of the signal lines $\mathbf{21}_1$ to $\mathbf{21}_m$ is connected to each output terminal corresponding to the columns of the signal line drive unit 30. The signal line drive unit 30 outputs signal voltages of video signals with a given gradient to the corresponding signal lines 21.

As described above, in a liquid crystal display apparatus, in order to prevent a deterioration in the specific resistance of liquid crystal and the like caused by continuously applying a DC voltage having the same polarity to a liquid crystal, AC drive is performed in which the polarity of a voltage, which is applied between a counter electrode and a pixel electrode, is reversed at given periods (for example, at frame periods).

In order to perform this AC drive, the signal line drive unit 30 outputs a video signal with a square-wave voltage, in which the polarity is reversed based on a common voltage $V_{com}$ applied to a counter electrode and described below, to the pixels 10 through the signal lines 21.

Each end of the scanning lines $\mathbf{22}_1$ to $\mathbf{22}_n$ is connected to each output terminal corresponding to the rows of the scanning line drive unit 40. The scanning line drive unit 40 writes the signal voltages of the video signals with a gradient, output from the signal line drive unit 30 to the signal lines $\mathbf{21}_1$ to $\mathbf{21}_m$, onto the pixels 10.

(Fundamental Circuit Configuration of Pixels)

A fundamental circuit configuration of the pixels 10 will be described using FIG. 2.

Figure 2:
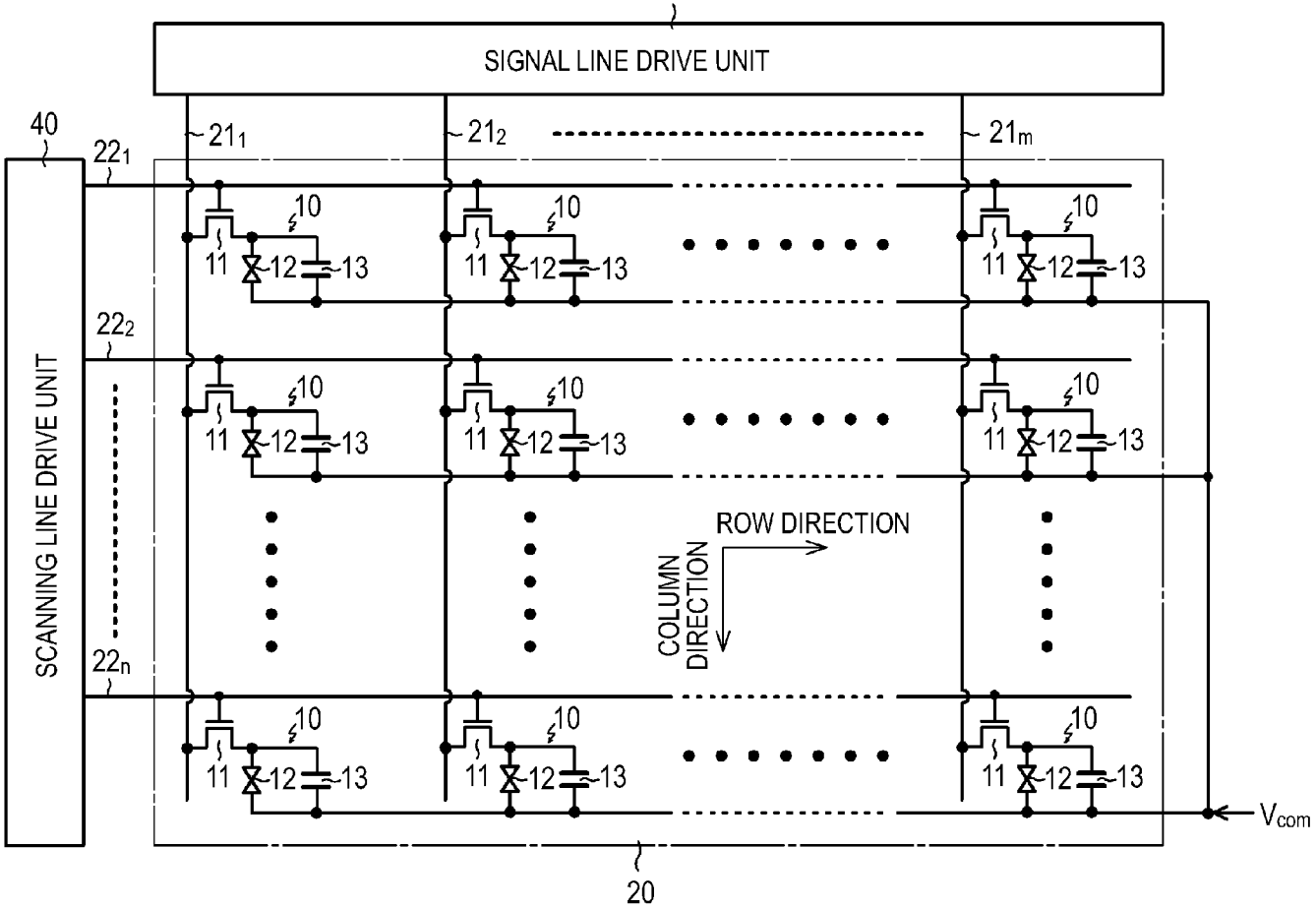
FIG. 2 is a circuit diagram illustrating a fundamental circuit configuration of pixels.

As illustrated in FIG. 2, the plural signal lines 21 ($\mathbf{21}_1$, $\mathbf{21}_2$, . . . , $\mathbf{21}_m$) and the plural scanning lines 22 ($\mathbf{22}_1$, $\mathbf{22}_2$, . . . , $\mathbf{22}_n$) are arranged so as to intersect with each other and the pixels 10 are disposed at the intersections thereof.

The pixels 10 include a pixel transistor 11 configured by, for example, a thin film transistor (TFT), a liquid crystal capacitor (liquid crystal element) 12, and a storage capacitor (pixel capacitor) 13. In the pixel transistor 11, a gate electrode is connected to one of the scanning lines 22 ($\mathbf{22}_1$, $\mathbf{22}_2$, . . . , $\mathbf{22}_n$) and one source/drain electrode is connected to one of the signal lines 21 ($\mathbf{21}_1$, $\mathbf{21}_2$, . . . , $\mathbf{21}_m$).

The liquid crystal capacitor 12 is a capacitance component of liquid crystal generated between a pixel electrode and a counter electrode which is formed opposite the pixel electrode. The pixel electrode is connected to the other source/drain electrode of the pixel transistor 11. In all the pixels, the common voltage $V_{com}$ which is DC voltage is applied to the counter electrode of the liquid crystal capacitor 12. In the storage capacitor 13, one electrode is connected to the pixel electrode of the liquid crystal capacitor 12 and the other electrode is connected to the counter electrode of the liquid crystal capacitor 12.

(Color Arrangement of Liquid Crystal Panel)

As described above, the liquid crystal display apparatus 1 according to the embodiment is a color liquid crystal display apparatus. Therefore, the pixels 10 illustrated in FIGS. 1 and 2 respectively correspond to plural subpixels configuring one pixel which is a unit of forming a color image. In the case of a monochrome liquid crystal display apparatus, each of the pixels 10 illustrated in FIGS. 1 and 2 corresponds to one pixel which is a unit of forming a monochrome image.

In the liquid crystal panel 50 according to the embodiment, one pixel which is a unit of forming a color image includes four subpixels corresponding to four colors. Specifically, as illustrated in FIGS. 3A and 3B, one pixel includes a first subpixel (represented by "R") which displays a first primary color (for example, red), a second subpixel (represented by "G") which displays a second primary color (for example, green), a third subpixel (represented by "B") which displays a third primary color (for example, blue), and a fourth subpixel (represented by "W") which displays a fourth color (for example, white).

Figure 3A:
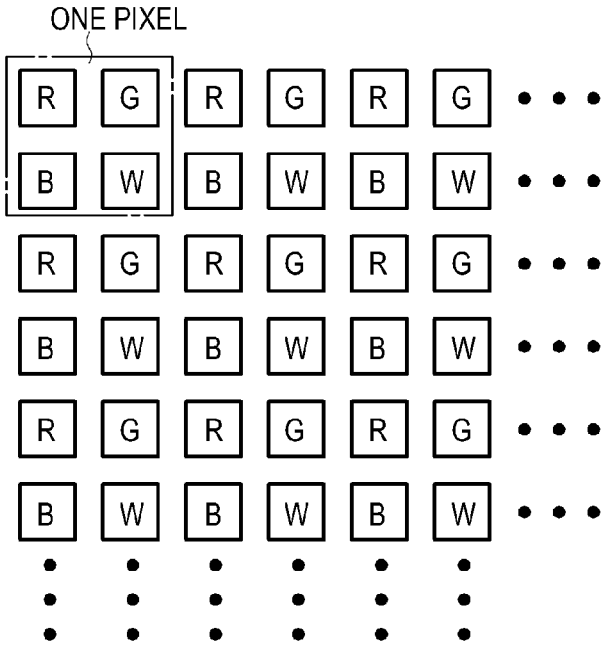
FIGS. 3A and 3B are diagrams illustrating the color arrangement of pixels (subpixels) of a liquid crystal panel.
Figure 3B:
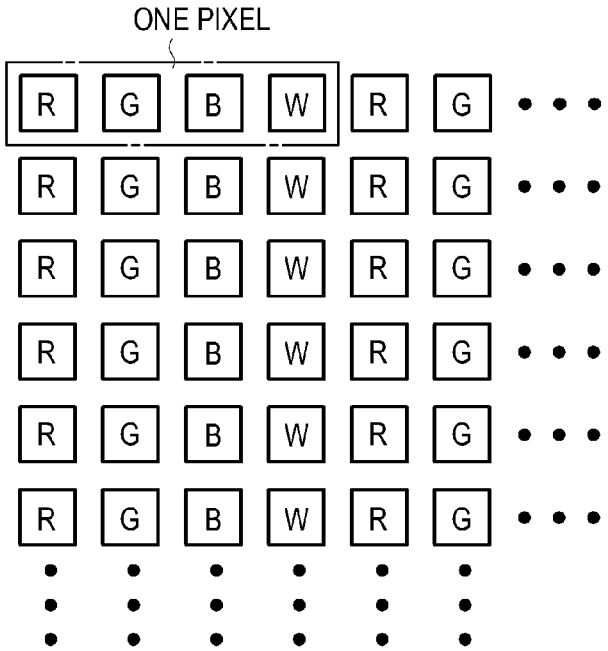

In an example illustrated in FIG. 3A, the first, second, third, and fourth subpixels are arranged in an array similar to a diagonal array (a mosaic array). In an example illustrated in FIG. 3B, the first, second, third, and fourth subpixels are arranged in an array similar to a stripe array.

By using a subpixel which displays, for example, white as the fourth subpixel, luminance can be improved. Alternatively, by using a subpixel which displays, for example, a complementary color as the fourth subpixel, a color reproduction range can be extended.

In this embodiment, the liquid crystal panel 50 in which one pixel, which is a unit of forming a color image, includes four subpixels corresponding to four colors has been described. However, the present disclosure is not limited thereto. For example, the present disclosure can be applied to a liquid crystal panel in which one pixel includes subpixels which display three primary colors RGB.

Returning to FIG. 1, the liquid crystal display apparatus 1 according to the embodiment has a configuration in which a backlight unit 60, a common voltage generating unit 70, a detection unit 80, and a controller 90 are provided outside the liquid crystal panel 50.

The backlight unit 60 is an illumination unit which illuminates the liquid crystal panel 50 with light from a back side thereof. A configuration of the backlight unit 60 is not particularly limited, and the backlight unit can be configured using well-known members including a light source such as a light emitting diode (LED) or a fluorescent tube, a prism sheet, a diffusion sheet, and a light guide plate. The luminance of the backlight unit 60 can be changed under the control of the controller 90.

A specific example of changing the luminance of the backlight unit 60 under the control of the controller 90 will be described.

For example, in a liquid crystal display apparatus having the four-subpixel configuration which includes the fourth color (for example, white), in order to improve luminance, when only the same luminance as that of the three-subpixel configuration not including the fourth color is necessary, the luminance of the backlight unit 60 can be reduced by an amount of luminance improved. By reducing the luminance of the backlight unit 60, power consumption can be reduced.

Therefore, in a liquid crystal display apparatus having the four-subpixel configuration including white, in order to reduce power consumption, for example, the luminance of the backlight unit 60 may be reduced. The luminance of the backlight unit 60 can be controlled to be changed according to a level of a video signal given (written) onto a pixel electrode. In the related art, a technique of controlling the luminance of the backlight unit 60 according a level of a video signal is disclosed (for example, JP-A-2010-33009). A control system for the luminance of the backlight unit 60 is not illustrated in the drawings.

Therefore, the detection unit 80 which detects the luminance of the backlight unit 60 can detect the luminance of the backlight unit 60 from a level of a video signal. The detection unit 80 according to the embodiment electrically detects the luminance of the backlight unit 60 from a level of a video signal. However, the detection unit 80 may also have a configuration of using a sensor which directly detects the luminance of the backlight unit 60.

In this embodiment, an example in which the detection unit 80 detects the luminance of the backlight unit 60 from a level of a video signal has been described, which is merely an example. In addition to this example, a method having the following configuration can be considered.

In a liquid crystal display apparatus having the four-subpixel configuration including white, the luminance of the entire screen can be improved by adding a white subpixel. By taking advantage of this characteristic, in mobile devices such as a mobile phone using the liquid crystal display apparatus as a display unit, the user can arbitrarily select between "a low power consumption mode" in which power consumption is reduced and "an outdoor mode" in which the luminance is improved, for example, two times for outdoor visibility. In this case, the detection unit 80 can detect the luminance of the backlight unit 60 from operation information pertaining to a mode selected by the user.

The common voltage generating unit 70 generates a common voltage $V_{com}$ for being applied to a counter electrode (common electrode), shared by the pixels 10, and applies the generated voltage to the liquid crystal panel 50. A configuration of the common voltage generating unit 70 is not particularly limited, and well-known circuit configurations can be used.

The common voltage $V_{com}$ is a reference voltage for AC drive of liquid crystal, for example, DC voltage. As described above, when AC drive such as frame reversal drive is performed, transmittance of light is different in a frame in which the voltage of the pixel electrodes is larger than that of the counter electrode and in a frame in which the voltage of the pixel electrodes is smaller than that of the counter electrode. As a result, display intensity varies depending on frames, which leads to screen flickering.

In order to minimize flickering, the common voltage $V_{com}$ is adjusted to the optimum voltage value (optimum value) in the manufacturing process of the liquid crystal panel 50 (liquid crystal display apparatus 1). That is, the optimum value of the common voltage $V_{com}$ at the time of shipment of the liquid crystal panel 50 (liquid crystal display apparatus 1) is a voltage value which is adjusted so as to minimize flickering. This adjustment of the common voltage $V_{com}$ is performed by the common voltage generating unit 70.

In the liquid crystal display apparatus 1 according to the embodiment, as described above, the luminance of the backlight unit 60 may be dynamically changed. When the changed luminance of the backlight unit 60 is different from the luminance of the backlight unit 60 measured when the common voltage $V_{com}$ is adjusted so as to minimize flickering, a voltage value of the common voltage $V_{com}$ is shifted from the optimum value. More specifically, as the luminance of the backlight unit 60 is relatively higher, a voltage value of the common voltage $V_{com}$ is reduced.

[2-2. Mechanism in Which Common Voltage $V_{com}$ Is Shifted From Optimum Value]

A mechanism in which a voltage value of the common voltage $V_{com}$ is shifted from the optimum value based on the luminance of the backlight unit 60 will be described.

A voltage value of the common voltage $V_{com}$ is changed in response to a leakage voltage of the pixel transistor 11 (refer to FIG. 2) caused by changes in the luminance of the backlight unit 60. In this embodiment, a case of using a double-gate transistor illustrated in FIG. 4A as the pixel transistor 11 will be described.

Figure 4A:
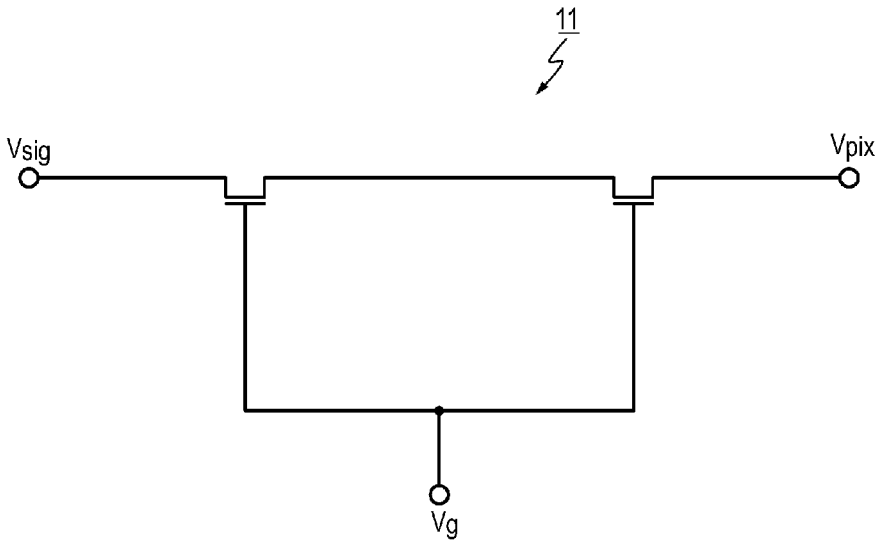
FIGS. 4A and 4B are diagrams illustrating a mechanism in which a voltage value of a common voltage $V_{com}$ is shifted from the optimum value based on the luminance of a backlight unit.
Figure 4B:
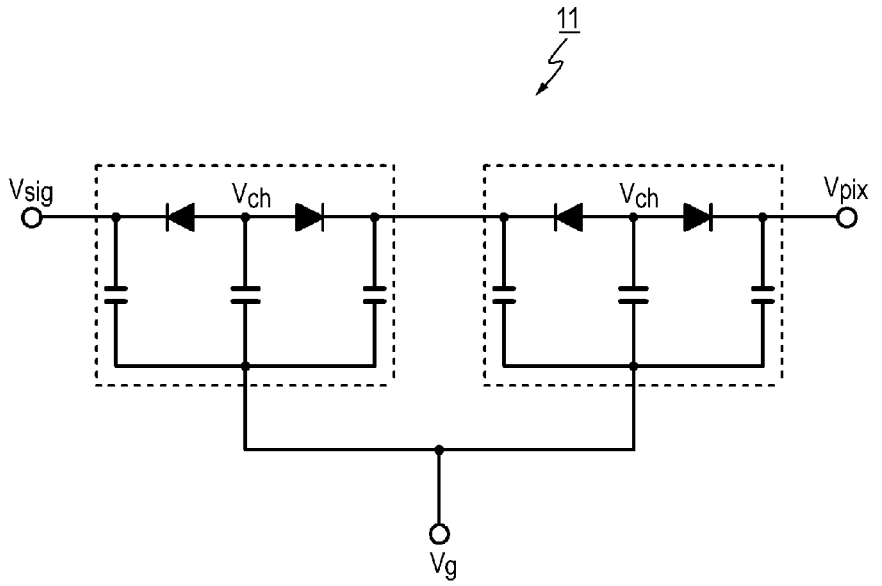

Regarding the double-gate pixel transistor 11, a case where pixel charges are stored will be described using a model illustrated in FIG. 4B. In FIGS. 4A and 4B, $V_{sig}$ represents a signal potential of a video signal written onto a pixel, $V_{pix}$ is a potential of a pixel electrode (hereinafter, referred to as "a pixel potential"), and $V_g$ represents a potential of a gate electrode (hereinafter, referred to as "a gate potential"). In addition, in FIG. 4B, $V_{ch}$ represents a potential of a channel region (hereinafter, referred to as "a channel potential").

After the pixel transistor 11 writes the signal potential $V_{sig}$ and immediately after the gate potential $V_g$ disappears, a value of the channel potential $V_{ch}$ is equal to a value of "$V_{g1}-V_{th}$". In this expression, $V_{g1}$, represents a low level of the gate potential $V_g$ when the pixel transistor 11 is offset and $V_{th}$ represents a threshold voltage of the pixel transistor 11.

Figure 5:
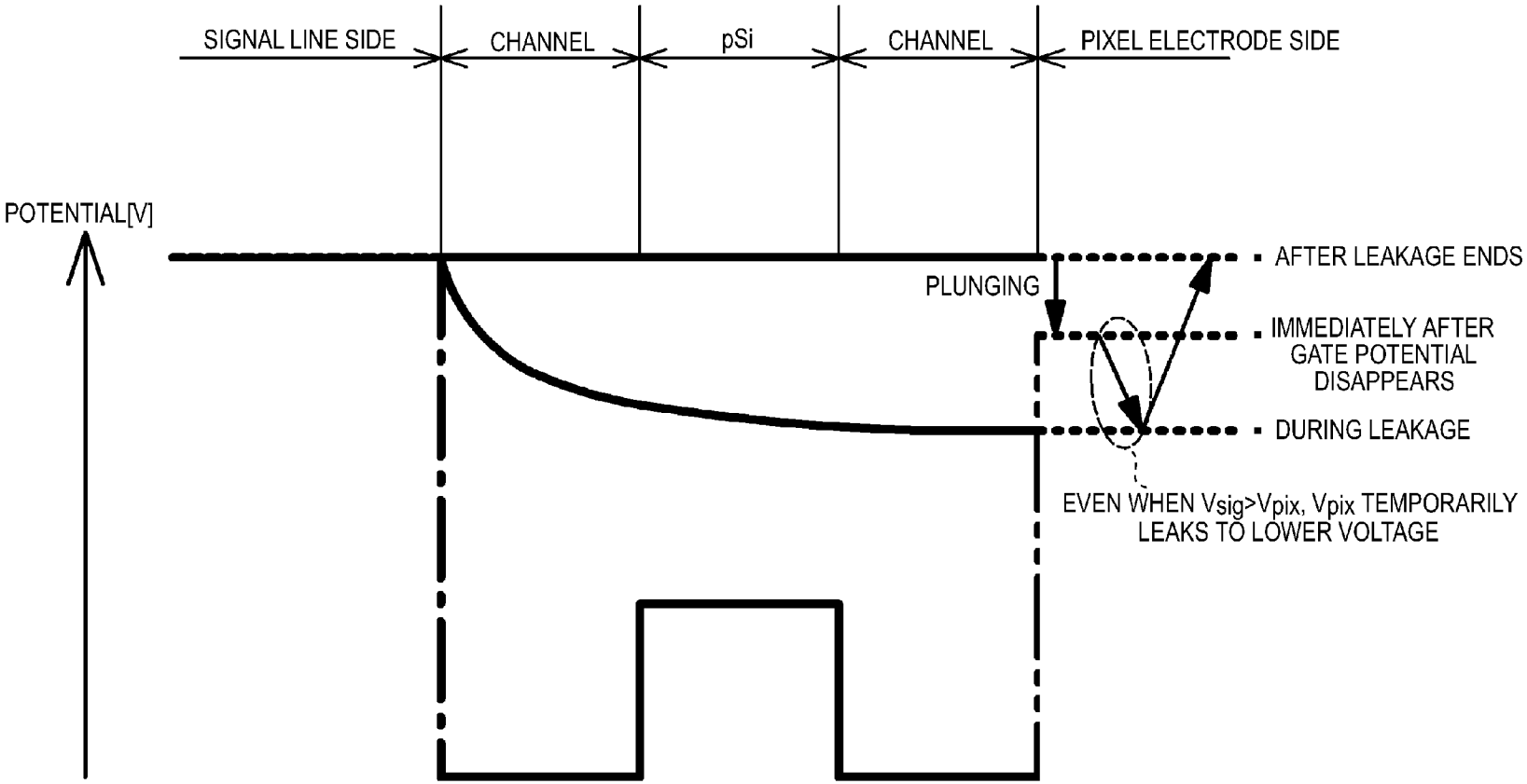
FIG. 5 is a diagram illustrating a state in which a pixel potential $V_{pix}$ temporarily leaks to a lower voltage even when $V_{sig}>V_{pix}$.

Since charge leak from the storage capacitor 13 (refer to FIG. 2) to a channel region having the channel potential $V_{ch}$, the pixel potential $V_{pix}$ inevitably drops, independent of the signal potential $V_{sig}$. That is, even in a case where $V_{sig}>V_{pix}$ when the pixel potential $V_{pix}$ is compared with the signal potential $V_{sig}$, the channel potential $V_{ch}$ is low and thus the pixel potential $V_{pix}$ temporarily leaks to a lower voltage. The state thereof is illustrated in FIG. 5.

When the channel potential $V_{ch}$ rises and the pixel potential $V_{pix}$ and a potential are reversed, the pixel potential $V_{pix}$ starts to rise. In general pixel configurations, or at the time of driving of the related art, however, there are many cases where the process proceeds to the next frame period before the pixel potential $V_{pix}$ starts to rise.

[2-3. Characteristics of Embodiment]

Therefore, the liquid crystal display apparatus 1 according to the embodiment has a configuration in which the detection unit 80 detects the luminance of the backlight unit 60 and the controller 90 controls the common voltage generating unit 70 based on a detection result thereof, specifically, controls the common voltage generating unit 70 such that a voltage value of the common voltage $V_{com}$ matches the optimum value.

The meaning of "a voltage value of the common voltage $V_{com}$ matches the optimum value" includes a substantial match as well as a complete match. A variety of variations which may occur by design or during manufacturing are allowable. In addition, "the optimum value" regarding the common voltage $V_{com}$ is a voltage value adjusted so as to minimize flickering.

It is assumed that when a difference between leakage current values of the pixel transistor 11 when the changed luminance of the backlight unit 60 has the maximum value and the minimum value is represented by $\Delta I_{photo}$[A], one frame period is represented by $T_f$[sec], and a pixel capacitance (of the storage capacitor 13) is represented by $C_{pic}$[F]. In addition, it is assumed that the maximum gradient between a DC value of the common voltage $V_{com}$ and a flicker rate is represented by S [%/V], a flicker rate of the common voltage $V_{com}$, which is adjusted so as to minimize flickering, is represented by F [%], and a standard flicker rate is represented by L [%]. At this time, the following relationship is satisfied.

$$\Delta I_{photo} \times T_f / C_{pic} \times S + F > L$$

As described above, by controlling a voltage value of the common voltage $V_{com}$ to the optimum value so as to minimize flickering based on the luminance of the backlight unit 60, the optimum voltage corresponding to a level of a video signal can be applied between a pixel electrode and the counter electrode based on the changed luminance of the backlight unit 60. As a result, a margin for flickering, screen burn-in, and other non-uniform display can be sufficiently secured and thus satisfactory image display can be performed.

EXAMPLE

A specific example of controlling a voltage value of the common voltage $V_{com}$ to the optimum value so as to minimize flickering based on the luminance of the backlight unit 60, will be described.

During inspection in the manufacturing step of the liquid crystal panel 50, the optimum value of the common voltage $V_{com}$ at a given luminance of the backlight unit 60 is measured to be registered in a memory (or a register) in advance. Furthermore, the optimum value of the common voltage $V_{com}$ at a luminance of the backlight unit 60 different from the above luminance is measured and the gradient of the optimum value of the common voltage $V_{com}$ to the luminance of the backlight unit 60 is calculated to be registered in a memory (or a register). As described above, "the optimum value of the common voltage $V_{com}$" which is measured in this embodiment is a voltage value of the common voltage $V_{com}$ which is adjusted so as to minimize flickering.

A voltage value of the common voltage $V_{com}$ is controlled by the controller 90 (refer to FIG. 1). The controller 90 controls a voltage value of the common voltage $V_{com}$ in the following procedure, based on the optimum values of the common voltage $V_{com}$ and the gradient of the optimum value to the luminance, which are registered in advance during inspection in the manufacturing step of the liquid crystal panel 50.

In this example, a case where the backlight unit 60 includes an LED will be described. The backlight unit 60 including an LED adopts, for example, a pulse width modulation (PWM) as a luminance adjusting method. A PWM duty for the luminance adjustment is stored in a register.

Figure 6:
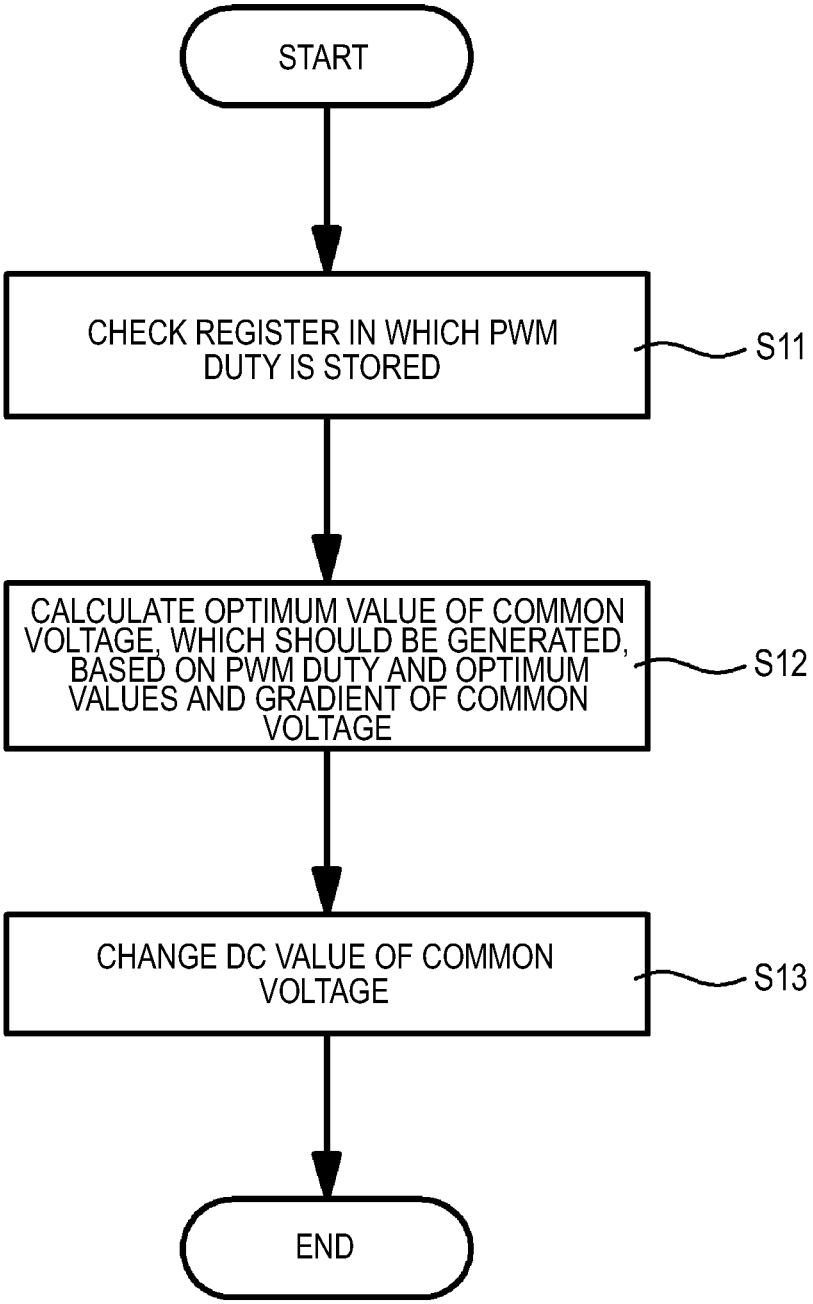
FIG. 6 is a flowchart illustrating a procedure of controlling a voltage value of a common voltage $V_{com}$ which is performed under the control of a controller.

FIG. 6 is a flowchart illustrating a procedure of controlling a voltage value of the common voltage $V_{com}$ which is performed under the control of a controller 90. A series of processes in this flowchart are repeated at each predetermined period (for example, at each frame period).

First, a register in which a PWM duty for the luminance adjustment of the LED backlight unit 60 is stored is checked to obtain the PWM duty (step S11). Next, a DC value of the common voltage $V_{com}$ which should be generated by the common voltage generating unit 70 (refer to FIG. 1) is obtained by, for example, calculation, based on the PWM duty which is obtained in step S11; and the optimum values of the common voltage $V_{com}$ and the gradient of the optimum value to the luminance, which are registered in advance in a memory (or the register) (step S12). Next, a DC value of the common voltage $V_{com}$, generated by the common voltage generating unit 70, is changed to the DC value obtained in step S12 (step S13).

The above-described series of processes are repeated at, for example, each frame period. Due to the above-described series of processes, a voltage value of the common voltage $V_{com}$ can be controlled to the optimum value so as to minimize flickering, based on the changed luminance of the backlight unit 60.

As the two luminances of the backlight unit 60 which are set during inspection in the manufacturing step of the liquid crystal panel 50, for example, 7000 [cd/m$^2$] and 13470 [cd/m$^2$] are set. The optimum value of the common voltage $V_{com}$ varies depending on the specification of the liquid crystal panel 50 and the like, but the inventors confirmed as a result of an actual measurement that the optimum value is, for example, about −260 [mV] at a luminance of 7000 [cd/m$^2$] and about −280 [mV] at a luminance of 13470 [cd/m$^2$].

[2-4. Modification]

In the above-described embodiment, the optimum values of the common voltage $V_{com}$ and the gradient of the optimum value to the luminance are registered in advance; and based on these values, a DC value of the common voltage $V_{com}$ corresponding to the luminance of the backlight unit 60 is calculated. However, the present disclosure is not limited thereto. For example, more simply, a method of registering two optimum values of the common voltage $V_{com}$ with binary values of the luminance of the backlight unit 60 and selecting either one based on the luminance of the backlight unit 60 or performing interpolation and extrapolation by linear approximation, can be adopted.

In addition, in the above-described embodiment, a voltage, which is applied between a pixel electrode and a counter electrode, is controlled based on the luminance of the backlight unit 60, by controlling a DC value of the common voltage $V_{com}$. However, the same operations and effects can be obtained by controlling a signal level of a video signal. That is, a voltage, which is applied between a pixel electrode and a counter electrode, can be controlled by controlling a signal level of a video signal based on the luminance of the backlight unit 60, and the optimum voltage corresponding to a level of a video signal can be applied between a pixel electrode and a counter electrode, based on the changed luminance of the backlight unit.

Examples of a method of controlling a signal level of a video signal based on the luminance of the backlight unit 60 include a method of controlling a power supply voltage of a circuit portion, which handles a video signal in, for example, an external driver for supplying a video signal to the liquid crystal panel 50, based on the luminance of the backlight unit 60. In addition to the above-described method, when a video signal is digital data, a method of shifting a gradient on the side of the digital data based on the luminance of the backlight unit 60 is considered.

(4. Electronic Apparatus)

The above-described liquid crystal display apparatus according to the embodiment can be used as a display unit (a display apparatus) of electronic apparatuses in various fields which display video signals input to the electronic apparatuses or video signals generated in the electronic apparatuses as a still image or a moving image.

As clearly seen from the above description of the embodiment, the liquid crystal display apparatus according to the embodiment can apply the optimum voltage corresponding to a level of a video signal between a pixel electrode and a counter electrode based on the luminance of the backlight unit 60. Therefore, a margin for flickering, screen burn-in, and other non-uniform display can be sufficiently secured. As a result, by using the liquid crystal display apparatus according to the embodiment as a display unit of electronic apparatuses in various fields, satisfactory image display can be realized.

Examples of the electronic apparatuses in which the liquid crystal display apparatus according to the embodiment is used as a display unit include digital cameras, video cameras, game devices, and laptop personal computers. In particular, when the technique of controlling the luminance of a backlight unit according to a level of a video signal is applied, the liquid crystal display apparatus according to the embodiment is preferably used as a display unit for electronic apparatuses such as mobile information devices (for example, electronic book devices and electronic wrist watches), mobile phones, and personal digital assistants (PDA).

<4. Configurations According to Embodiments of Present Disclosure>

The present disclosure can be implemented as the following configurations.

(1) A liquid crystal display apparatus including:

a detection unit that detects the luminance of a backlight unit; and a controller that controls a voltage of a counter electrode, shared by pixels, based on a detection result of the detection unit.

(2) The liquid crystal display apparatus according to (1) above, wherein each of the pixels includes a first subpixel which displays a first primary color, a second subpixel which displays a second primary color, a third subpixel which displays a third primary color, and a fourth subpixel which displays a fourth color.

(3) The liquid crystal display apparatus according to (2) above, wherein the fourth subpixel is a white subpixel which displays white.

(4) The liquid crystal display apparatus according to (3) above, wherein the luminance of the backlight unit is changed according to a level of a video signal applied to a pixel electrode.

(5) The liquid crystal display apparatus according to (4) above, wherein the detection unit detects the luminance of the backlight unit from a level of the video signal.

(6) The liquid crystal display apparatus according to any one of (1) to (5) above, wherein the controller controls a common voltage, applied to the counter electrode, based on a detection result of the detection unit.

(7) The liquid crystal display apparatus according to (6), wherein each of the pixels includes a pixel transistor that applies the video signal to the pixel electrode, and when a difference between leakage current values of the pixel transistor when the changed luminance of the backlight unit has the maximum value and the minimum value is represented by $\Delta I_{photo}$[A], one frame period is represented by $T_f$[sec], a pixel capacitance is represented by $C_{pic}$[F], the maximum gradient between a DC value of the common voltage and a flicker rate is represented by S[%/V], a flicker rate of the common voltage, which is adjusted so as to minimize flickering, is represented by F[%], and a standard flicker rate is represented by L[%], an expression of $\Delta I_{photo} \times T_f / C_{pic} \times S + F > L$ is satisfied.

(8) The liquid crystal display apparatus according to any one of (1) to (5) above, wherein the controller controls a signal level of the video signal based on a detection result of the detection unit.

(9) A method of driving a liquid crystal display apparatus including:

detecting the luminance of a backlight unit; and controlling a voltage of a counter electrode, shared by pixels, based on a detection result for the luminance of the backlight unit.

(10) An electronic apparatus including:

a liquid crystal display apparatus that includes a detection unit which detects the luminance of a backlight unit and a controller which controls a voltage of a counter electrode, shared by pixels, based on a detection result of the detection unit.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A liquid crystal display apparatus comprising:

a detection unit that detects a luminance of a backlight unit; and a controller that controls a voltage of a counter electrode, shared by pixels, based on a detection result of the detection unit, wherein each of the pixels includes a first subpixel which displays a first primary color, a second subpixel which displays a second primary color, a third subpixel which displays a third primary color, and a fourth subpixel which displays a fourth color;

wherein the controller is configured to change a first video signal that is input from outside into a second video signal;

wherein the first video signal includes first gradient information regarding gradient values of the first subpixel, the second subpixel, and the third subpixel;

wherein the second video signal includes second gradient information regarding gradient values of the first subpixel, the second subpixel, the third subpixel, and the fourth subpixel;

wherein the luminance of the backlight unit is changed according to a level of the second video signal applied to a pixel electrode;

wherein the detection unit is configured to detect the luminance of the backlight unit from the level of the second video signal;

wherein the controller controls a common voltage, applied to the counter electrode, based on a detection result of the detection unit, and wherein each of the pixels includes a pixel transistor that applies the second video signal to a pixel electrode, and when a difference between leakage current values of the pixel transistor when the changed luminance of the backlight unit has the maximum value and the minimum value is represented by $\Delta I_{photo}$[A], one frame period is represented by $T_f$[sec], a pixel capacitance is represented by $C_{pic}$[F], the maximum gradient between a DC value of the common voltage and a flicker rate is represented by S[%/V], a flicker rate of the common voltage, which is adjusted so as to minimize flickering, is represented by F[%], and a standard flicker rate is represented by L[%], an expression of $\Delta I_{photo} \times T_f / C_{pic} \times S + F > L$ is satisfied.

2. The liquid crystal display apparatus according to claim 1, wherein the fourth subpixel is a white subpixel which displays white.

3. The liquid crystal display apparatus according to claim 1, wherein the controller controls a signal level of the second video signal based on a detection result of the detection unit.

4. The liquid crystal display apparatus according to claim 1, wherein the liquid display apparatus further comprises a memory to store a proportional constant between an optimum value of the common voltage and the luminance of the backlight, wherein the proportional constant is calculated based on a first optimum value of the common voltage at a first luminance of the backlight and a second optimum voltage of the common voltage at a second luminance of the backlight, and wherein the control unit is configured to control the common voltage based on the proportional constant stored in the memory.

5. A method of driving a liquid crystal display apparatus comprising:

detecting a luminance of a backlight unit; and controlling a voltage of a counter electrode, shared by pixels, based on a detection result for the luminance of the backlight unit, wherein each of the pixels includes a first subpixel which displays a first primary color, a second subpixel which displays a second primary color, a third subpixel which displays a third primary color, and a fourth subpixel which displays a fourth color;

wherein a first video signal that is input from outside is changed into a second video signal;

wherein the first video signal includes first gradient information regarding gradient values of the first subpixel, the second subpixel, and the third subpixel;

wherein the second video signal includes second gradient information regarding gradient values of the first subpixel, the second subpixel, the third subpixel, and the fourth subpixel;

wherein the luminance of the backlight unit is changed according to a level of the second video signal applied to a pixel electrode;

wherein the luminance of the backlight unit is detected from the level of the second video signal;

wherein the controller controls a common voltage, applied to the counter electrode, based on a detection result of the detection unit, and wherein each of the pixels includes a pixel transistor that applies the second video signal to a pixel electrode, and when a difference between leakage current values of the pixel transistor when the changed luminance of the backlight unit has the maximum value and the minimum value is represented by $\Delta I_{photo}$[A], one frame period is represented by $T_f$[sec], a pixel capacitance is represented by $C_{pic}$[F], the maximum gradient between a DC value of the common voltage and a flicker rate is represented by S[%/V], a flicker rate of the common voltage, which is adjusted so as to minimize flickering, is represented by F[%], and a standard flicker rate is represented by L[%], an expression of $\Delta I_{photo} \times T_f / C_{pic} \times S + F > L$ is satisfied.

6. An electronic apparatus comprising:

a liquid crystal display apparatus that includes a detection unit which detects a luminance of a backlight unit and a controller which controls a voltage of a counter electrode, shared by pixels, based on a detection result of the detection unit, wherein each of the pixels includes a first subpixel which displays a first primary color, a second subpixel which displays a second primary color, a third subpixel which displays a third primary color, and a fourth subpixel which displays a fourth color;

wherein the controller is configured to change a first video signal that is input from outside into a second video signal;

wherein the first video signal includes first gradient information regarding gradient values of the first subpixel, the second subpixel, and the third subpixel;

wherein the second video signal includes second gradient information regarding gradient values of the first subpixel, the second subpixel, the third subpixel, and the fourth subpixel;

wherein the luminance of the backlight unit is changed according to a level of the second video signal applied to a pixel electrode;

wherein the detection unit is configured to detect the luminance of the backlight unit from the level of the second video signal, wherein the controller controls a common voltage, applied to the counter electrode, based on a detection result of the detection unit, and wherein each of the pixels includes a pixel transistor that applies the second video signal to a pixel electrode, and when a difference between leakage current values of the pixel transistor when the changed luminance of the backlight unit has the maximum value and the minimum value is represented by $\Delta I_{photo}$[A], one frame period is represented by $T_f$[sec], a pixel capacitance is represented by $C_{pic}$[F], the maximum gradient between a DC value of the common voltage and a flicker rate is represented by S[%/V], a flicker rate of the common voltage, which is adjusted so as to minimize flickering, is represented by F[%], and a standard flicker rate is represented by L[%], an expression of $\Delta I_{photo} \times T_f / C_{pic} \times S + F > L$ is satisfied.

* * * * *